US010406666B2

(12) United States Patent
Lai

(10) Patent No.: US 10,406,666 B2
(45) Date of Patent: Sep. 10, 2019

(54) STAPLER WITH A DAMPING DEVICE

(71) Applicant: Pao Shen Enterprises Co., Ltd., Chang Hua (TW)

(72) Inventor: Wen-Chin Lai, Chang Hua (TW)

(73) Assignee: PAO SHEN ENTERPRISES CO., LTD., Chang Hua (TW)

( * ) Notice: Subject to any disclaimer, the term of this patent is extended or adjusted under 35 U.S.C. 154(b) by 411 days.

(21) Appl. No.: 15/455,693

(22) Filed: Mar. 10, 2017

(65) Prior Publication Data

US 2018/0141199 A1 May 24, 2018

(30) Foreign Application Priority Data

Nov. 23, 2016 (TW) ..... 105138344 A

(51) Int. Cl.
*B25C 5/16* (2006.01)
*B25C 5/02* (2006.01)

(52) U.S. Cl.
CPC ..... *B25C 5/1617* (2013.01); *B25C 5/025* (2013.01); *B25C 5/162* (2013.01)

(58) Field of Classification Search
CPC ..... B25C 5/1617; B25C 5/162; B25C 5/025; B25C 5/16; B25C 5/1606; B25C 5/1696
USPC ..... 227/120, 127, 128; 173/210, 211
See application file for complete search history.

(56) References Cited

U.S. PATENT DOCUMENTS 4,186,863 A * 2/1980 Yunoki ..... B25C 5/0228 227/131
7,080,768 B2 * 7/2006 Marks ..... B25C 5/025 227/119
2007/0158384 A1 * 7/2007 Zins ..... B25C 5/0242 227/132
2009/0152318 A1 * 6/2009 Matsukawa ..... B25C 5/0207 227/129
2011/0139850 A1 * 6/2011 Marks ..... B25C 5/025 227/120
2012/0061444 A1 * 3/2012 Wang ..... B25C 5/025 227/127
2013/0292446 A1 * 11/2013 Choy ..... B25C 5/06 227/120

* cited by examiner

*Primary Examiner* — Alexander M Valvis
*Assistant Examiner* — Katie L Gerth
(74) *Attorney, Agent, or Firm* — Burris Law, PLLC

(57) ABSTRACT

A stapler includes a base, a handle pivotably connected to the base, and a magazine unit having a channel body which is pivotably attached to the base, a magazine body which is coaxially disposed to and movable relative to the channel body in a lengthwise direction, and a magazine ejection spring disposed to bias the magazine track to make an ejection movement. The magazine unit further has a damping module disposed on the magazine track and having two spring-biased damping members which are movable relative to the magazine track to be slidably moved on and frictionally engaged with inner wall surfaces of two outer lateral wails of the channel body so as to retard the ejection movement of the magazine track.

8 Claims, 17 Drawing Sheets

STAPLER WITH A DAMPING DEVICE

CROSS-REFERENCE TO RELATED APPLICATION

This application claims priority of Taiwanese Patent Application. No. 105138344, filed on. Nov. 23, 2016.

FIELD

The disclosure relates to a stapler, and more particularly to a stapler having a damping device for reducing an ejection speed of a magazine track.

BACKGROUND

Referring to FIG. 1, a conventional stapler includes a base 1, a handle 2 pivotably connected to the base 1, a channel body 3 pivotably attached to the base 1 and downwardly of the handle 2, and a magazine track 4 coaxially disposed to and movable relative to the channel body 3. To load staples on the magazine track 4, a push button 21 on the handle 2 is pressed to eject the magazine track 4 forwardly from the channel body 3 by means of a biasing action of a compression spring (not shown) interposed between the channel body 3 and the magazine track 4. However a sudden and rapid ejection of the magazine track 4 generates an impact force that may hurt the user.

SUMMARY

Therefore, an object of the disclosure is to provide a stapler having a damping device that can reduce an ejection speed of a magazine track thereof.

According to the disclosure, the stapler includes a base having a base rear end, a handle pivotably connected to the base rear end of the base at a handle rear end, and a magazine unit interposed between the base and the handle. The magazine unit includes a magazine module and a damping module. The magazine module has a channel body which is pivotably attached to the base rear end at a channel rear end thereof and which is elongated in a lengthwise direction from the channel rear end to terminate at a channel front end, a magazine track which is coaxially disposed to and movable relative to the channel body in the lengthwise direction between a first position, where a magazine front end thereof is proximate to the channel front end, and a second position, where the magazine front end is distal from the channel front end, a pressing slider which is movably disposed between the channel body and the magazine track and adjacent to the channel front end of the channel body, and a magazine ejection spring which is disposed between the pressing slider and the channel body to bias the magazine track to the second position. The channel body is operably connected with the handle and has two outer lateral walls which are spaced apart from each other in a transverse direction that is transverse to the lengthwise direction and which are disposed outboard of the magazine track. Each of the outer lateral walls has an inner wall surface and a first recess which is formed in the inner wall surface and which is elongated forwardly and in the lengthwise direction to terminate at a first front recessed segment. The inner wall surface has a first inclined surface portion which defines the first front recessed segment, and a first friction portion which extends forwardly from the first inclined surface portion. The first inclined surface portions of the outer lateral walls are gradually and forwardly converged toward each other.

The damping module is disposed on the magazine track, and has two damping members which are movable relative to the magazine track in the transverse direction and which respectively have friction ends that are respectively disposed in the recesses when the magazine track is in the first position, and a biasing member which is disposed to bias the damping members in the transverse direction toward the inner wall surfaces of the outer lateral walls, respectively. Thus, when the magazine track is moved from the first position to the second position, each of the friction ends slidably moved on and frictionally engaged with at least one of the first inclined surface portion and the first friction portion.

With the frictional engagement between the damping members and the inner wall surfaces of the outer lateral walls, the ejection movement of the magazine track from the channel body is retarded for safe purposes.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
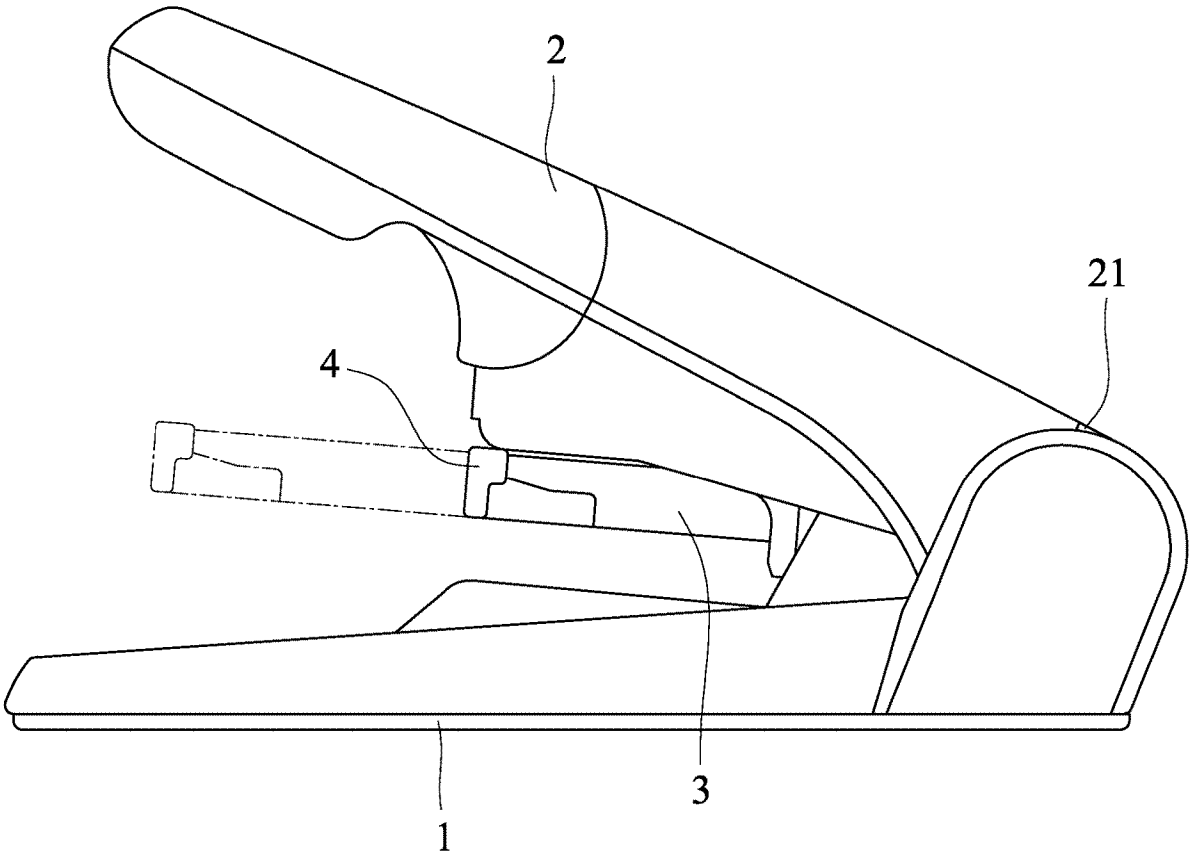
FIG.1 PRIOR ART
FIG. 1 is a schematic side view of a conventional stapler.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
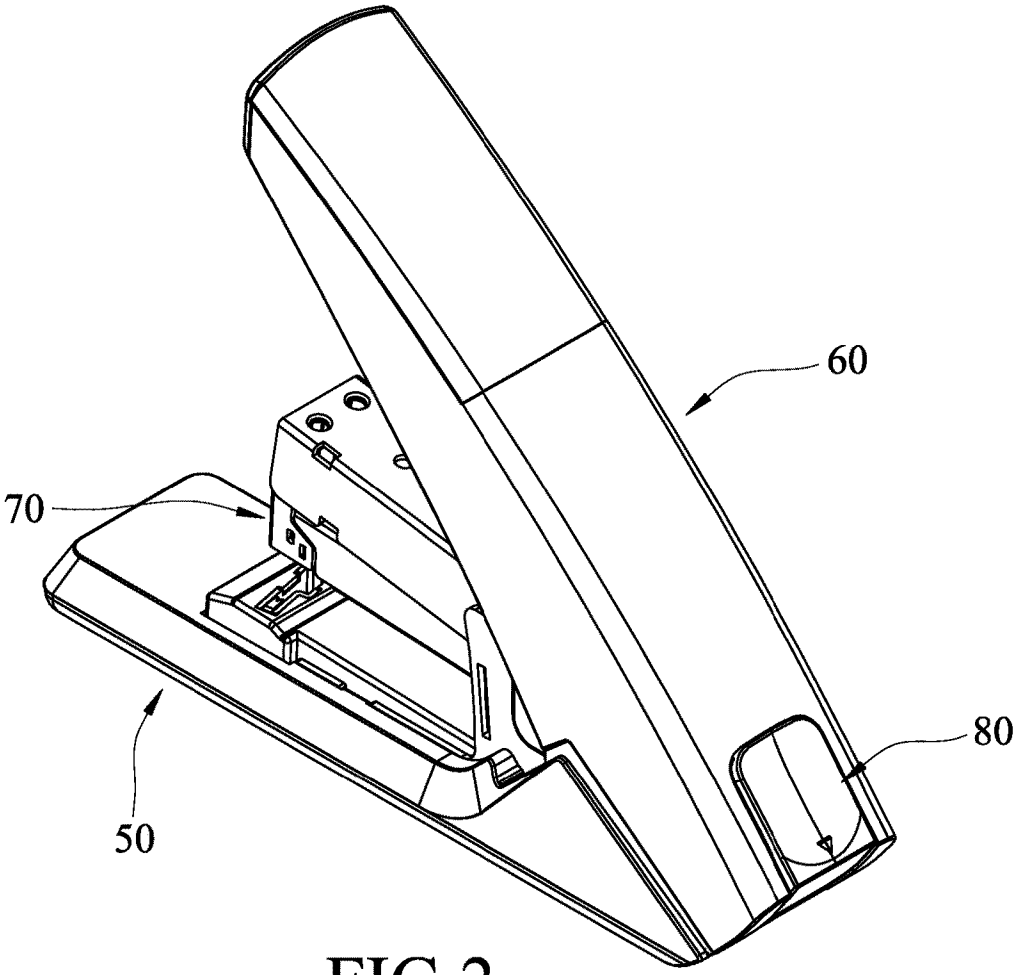
FIG. 2 is a perspective view of an embodiment of a stapler according to the disclosure.
Figure 3:
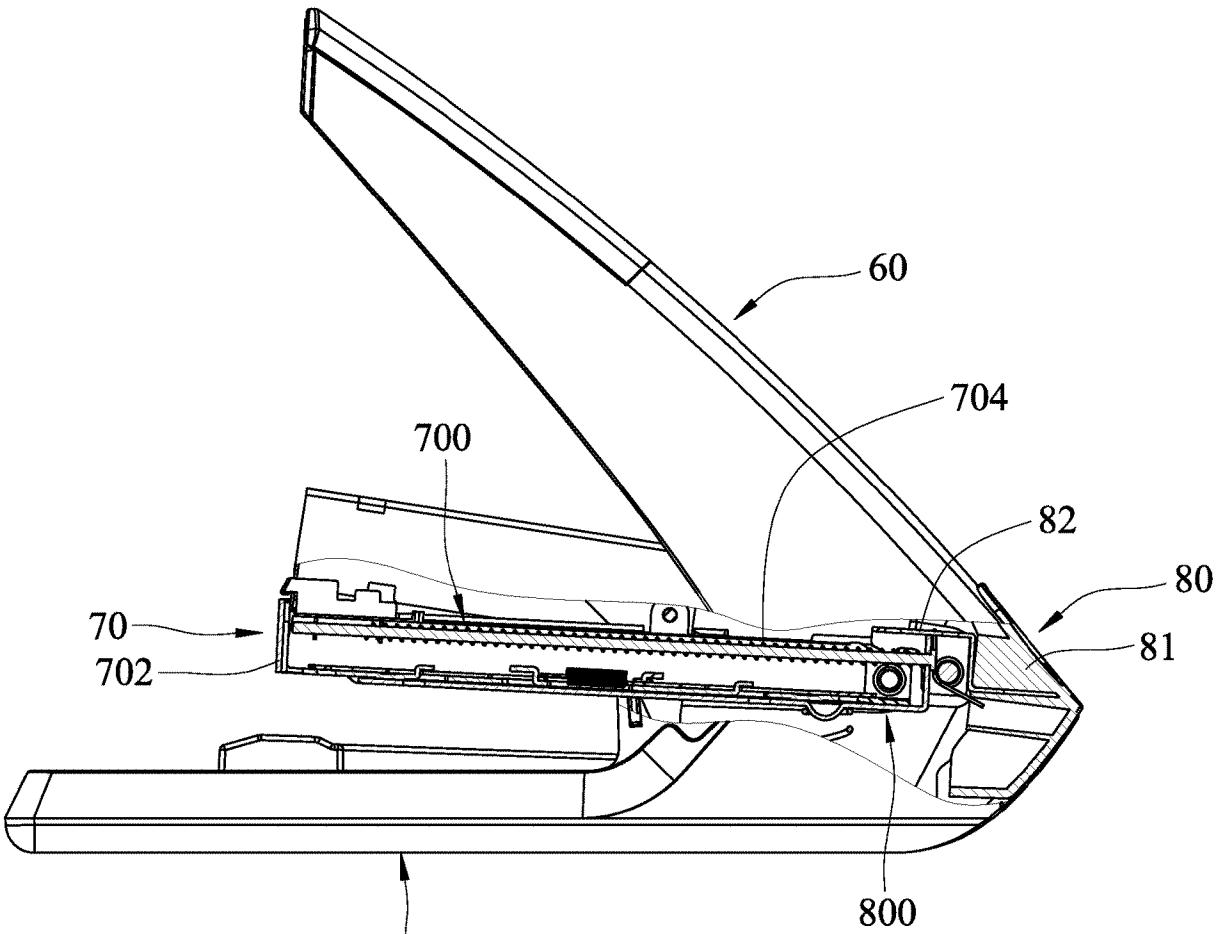
FIG. 3 is a partly sectioned side view of the embodiment.

Referring to FIGS. 2 and 3, an embodiment of a stapler according to the disclosure includes a base 50 having a base rear end, a handle 60 pivotably connected to the base rear end at a handle rear end, a magazine unit 70 interposed between the base 50 and the handle 60, and an operating unit 80. The magazine unit 70 includes a magazine module 700 and a damping module 800 disposed on the magazine module 700.

Figure 4:
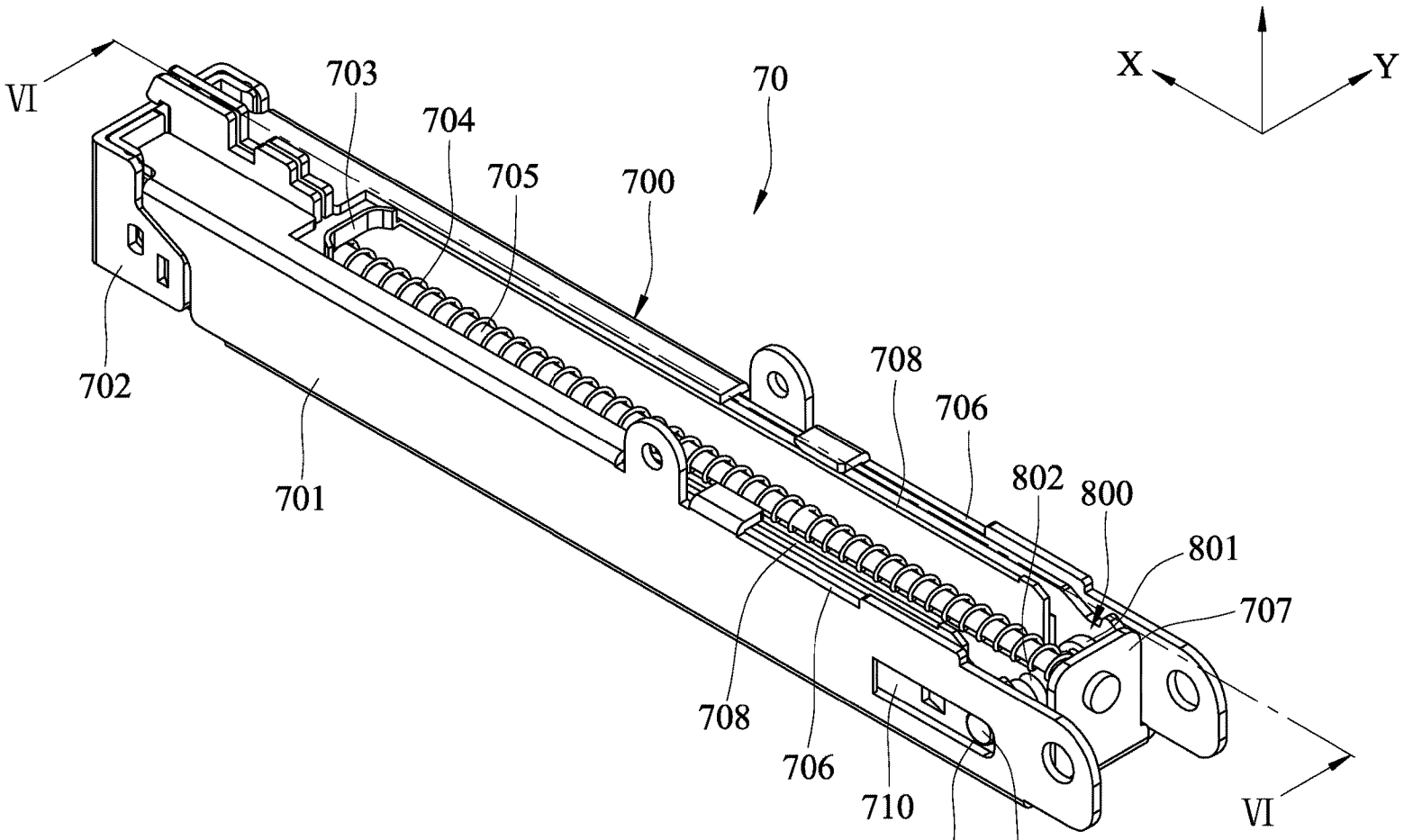
FIG. 4 is a perspective view illustrating a magazine unit of the embodiment.
Figure 5:
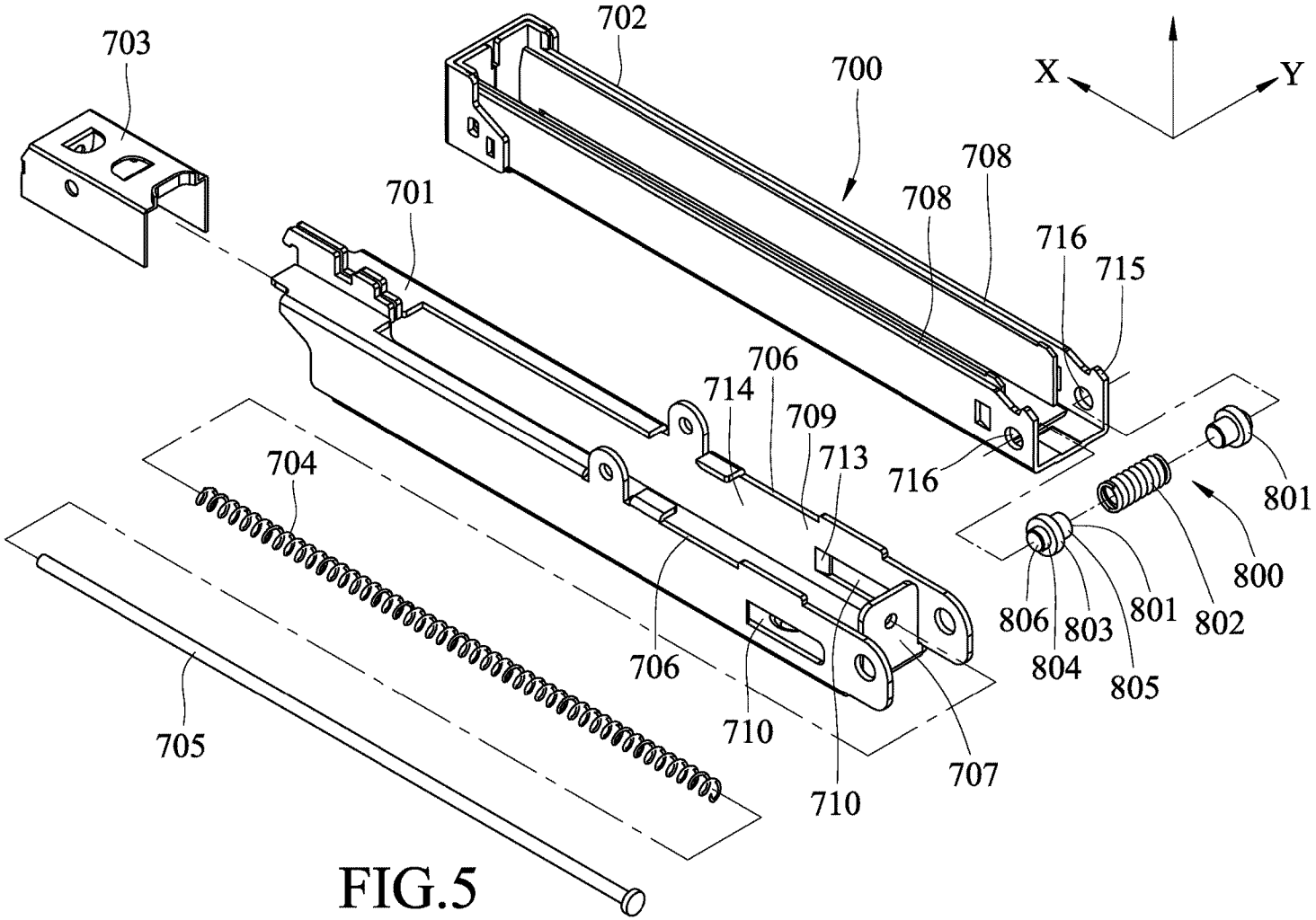
FIG. 5 is an exploded perspective view of the magazine unit.
Figure 7:
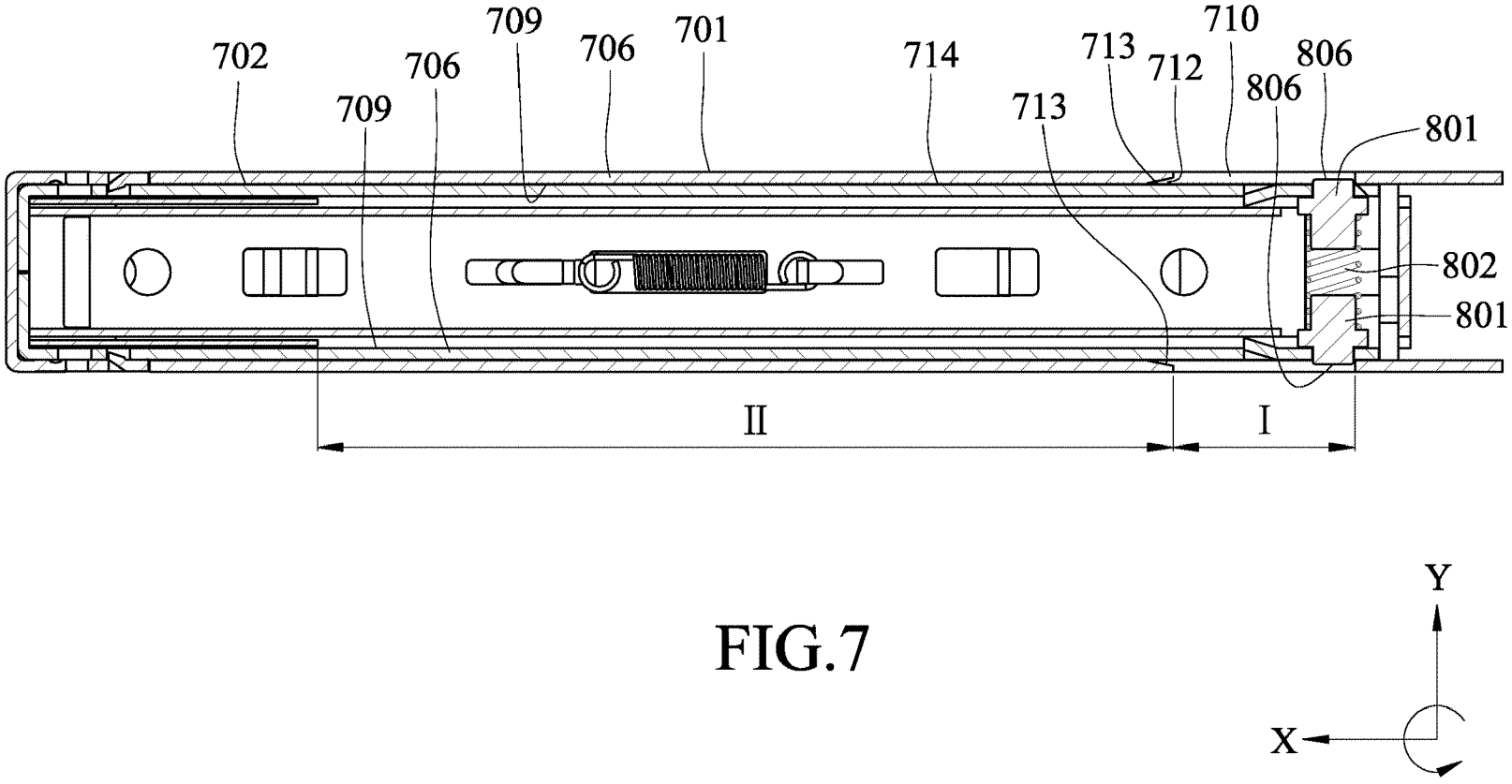
FIG. 7 is a sectional top view illustrating a state when a magazine track of the magazine unit is in a first position.
Figure 9:
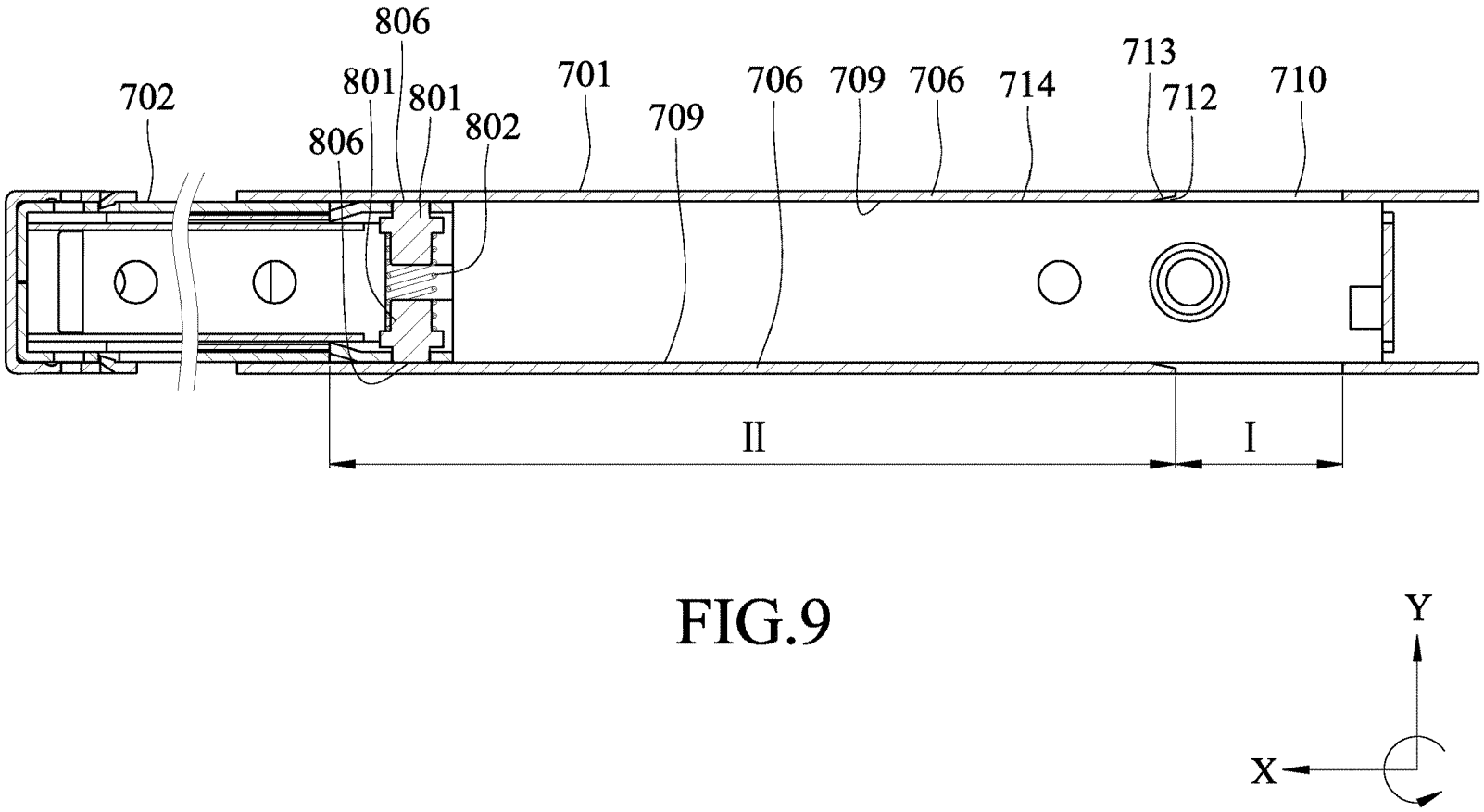
FIG. 9 is a sectional top view illustrating a state when the magazine track is in a finish of the second position.

With reference to FIG. 4, a magazine module 700 has a channel body 701 which is pivotably attached to the base rear end of the base 50 at a channel rear end thereof and which is elongated in a lengthwise direction (X) from the channel rear end to terminate at a channel front end, a magazine track 702 which is coaxially disposed to and movable relative to the channel body 701 in the lengthwise direction (X) between a first position (I) (as shown in FIG. 7), where a magazine front end thereof is proximate to the channel front end, and a second position (II) (as shown in FIG. 9), where the magazine front end is distal from the channel front end, a pressing slider 703 which is movably disposed between the channel body 701 and the magazine track 702 and adjacent to the channel front end of the channel body 701, a magazine ejection spring 704 which is disposed between the pressing slider 703 and the channel body 701 to bias the magazine track 702 to the second position (II), and a central shaft 705 on which the pressing slider 703 is slidable. The channel body 701 is operably connected with the handle 60 and has two outer lateral walls 706 which are spaced apart from each other in a transverse direction (Y) that is transverse to the lengthwise direction (X) and which are disposed outboard of the magazine track 702, and a rear wall 707 which is disposed between the outer lateral walls 706 and at the channel rear end and which confronts the pressing slider 703. The magazine track 702 has two inner lateral walls 708 which are spaced apart from each other in the transverse direction (Y) and which are disposed inboard of the outer lateral walls 706. The central shaft 705 is disposed between the rear wall 707 and the pressing slider 703 and is elongated in the lengthwise direction such that the pressing slider 703 is slidable relative to the central shaft 705 in the lengthwise direction (X). In this embodiment, the magazine ejection spring 704 a compression coil spring which is sleeved around the central shaft 705 and which abuts against the pressing slider 703 and the rear wall 707. Pressing the handle 60 by the user results in movement of the magazine unit 70 during use.

Referring to FIGS, 5 to 7, each of the outer lateral walls 706 of the channel body 701 has an inner wall surface 709 and a first recess 710 which is formed in the inner wall surface 709 and which is elongated forwardly and in the lengthwise direction (X) from the channel rear end to terminate at a first front recessed segment 712. In this embodiment, the first recess 710 is formed to penetrate through the outer lateral wall 706. The inner wall-surface 709 has a first inclined surface portion 713 which defines the first front recessed segment 712, and a first friction portion 714 which extends forwardly from the first inclined surface portion 713. The first inclined surface portions 713 of the outer lateral walls 706 are gradually and forwardly converged toward each other.

Each of the inner lateral walls 708 of the magazine track 702 has a rear end portion 715 adjacent to the channel rear end, and a through hole 716 formed through the rear end portion 715.

The damping module 800 is disposed on the magazine track 702, and has two damping members 801 which are movable relative to the magazine track 702 in the transverse direction (Y), and a biasing member 802 which is disposed between the damping members 801. In this embodiment, each damping member 801 has a shoulder portion 803, an outer shaft portion 804 which extends outwardly from the shoulder portion 803 in the transverse direction (Y) and through the through hole 716 to terminate at a friction end 806, and an inner shaft portion 805 which extends inwardly from the shoulder portion 803 in the transverse direction (Y). In this embodiment, each damping member 801 may be made from silicon, rubber, synthetic rubber, elastomeric plastic material, etc.

In this embodiment, the biasing member 802 is a compression coal spring which abuts against the shoulder portions 803 of the damping members 801 and which is sleeved around the inner shaft portions 805 of the damping members 801 to bias the friction ends 806 of the damping members 801 in the transverse direction (Y) toward the inner wall surfaces 709 of the outer lateral walls 706, respectively.

Figure 6:
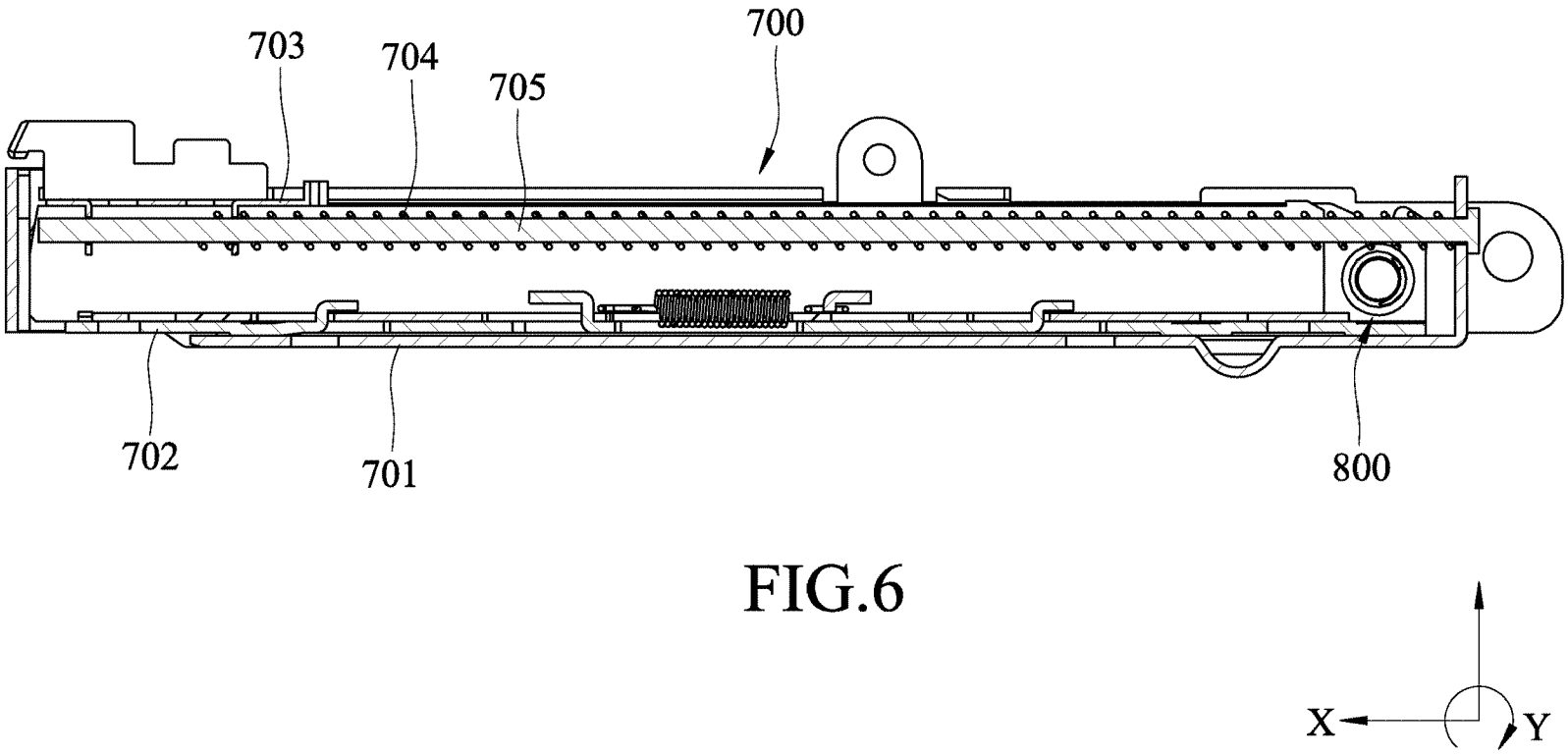
FIG. 6 is a sectional view taken along line VI-VI of FIG. 4.
Figure 8:
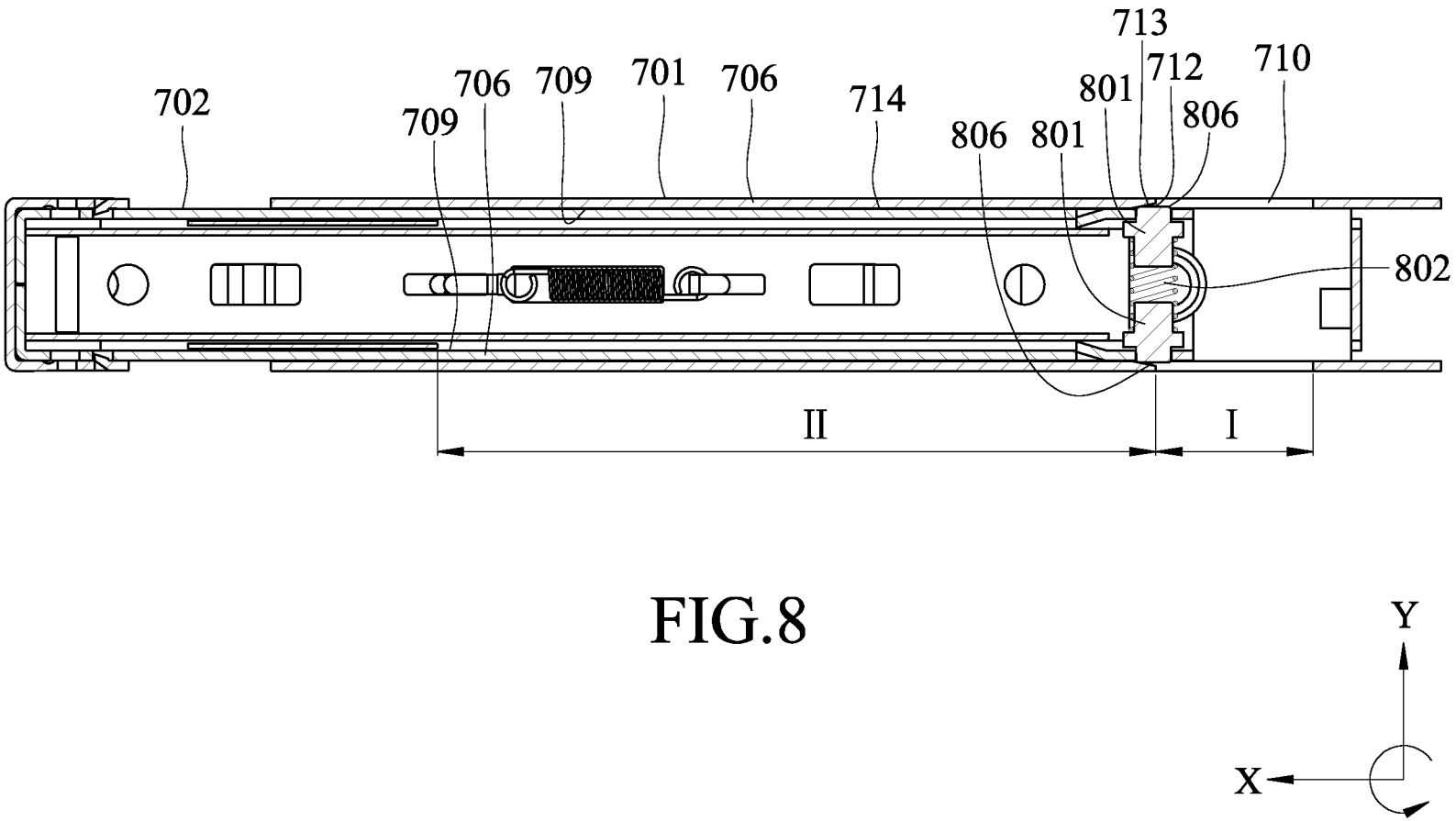
FIG. 8 is a sectional top view illustrating a state when the magazine track is moved to a start of a second position.

Referring to FIG. 7, when the magazine track 702 is in the first position (I), the friction end 806 of each damping member 801 is disposed in the respective recess 710, and the magazine ejection spring 704 is compressed (see FIG. 6) to have a biasing force to bias the magazine track 702 toward the second position (II). Referring to FIGS. 8 and 9, when the magazine track 702 is moved from the first position (I) to the second position (II), each of the friction ends 806 is slidably moved on and frictionally engaged with one of the first inclined surface portion 713 and the first friction portion 714. Specifically, as shown in FIG. 8, when the magazine track 702 is in a start of the second position, each friction end 806 is in frictional engagement with the first inclined surface portion 713. As shown in FIG. 9, when the magazine track 702 is in a finish of the second position, each friction end 806 is in frictional engagement with the first friction portion 714. In this embodiment, the first recess 710 is configured to penetrate through the outer lateral wall 706 such that the friction end 806 of each damping member 801 is not in contact with the inner wall surface 709 of the outer lateral wall 706 of the channel body 701. In other various embodiments, the first recess 710 may be configured to be recessed but not to penetrate through the outer lateral wall 706 so as to be in slight engagement with the friction end 806 of the damping member 801.

Referring to FIG. 3, the operating unit 80 is operably connected with the magazine track 702, and has a push button 81 and a retaining member 82 which is disposed to releasably retain the magazine track 702 to the first position. By pressing the push button 81, the retaining member 82 is actuated to release the magazine track 702 to permit a forward movement of the magazine track 702 by means of the biasing force of the magazine ejection spring 704.

During the ejection movement of the magazine track 702 from the first position (I) to the second position (II), the friction ends 806 of the damping members 801 are firstly moved to pass over the first recesses 710 without frictional engagement with the inner wall surfaces 709 of the outer lateral walls 706 so as to be smoothly moved forwardly. Subsequently, with the frictional engagement between the inner wall surfaces 709 and the damping members 801, the ejection movement of the magazine track 702 is retarded to prevent injury to the user.

Figure 10:
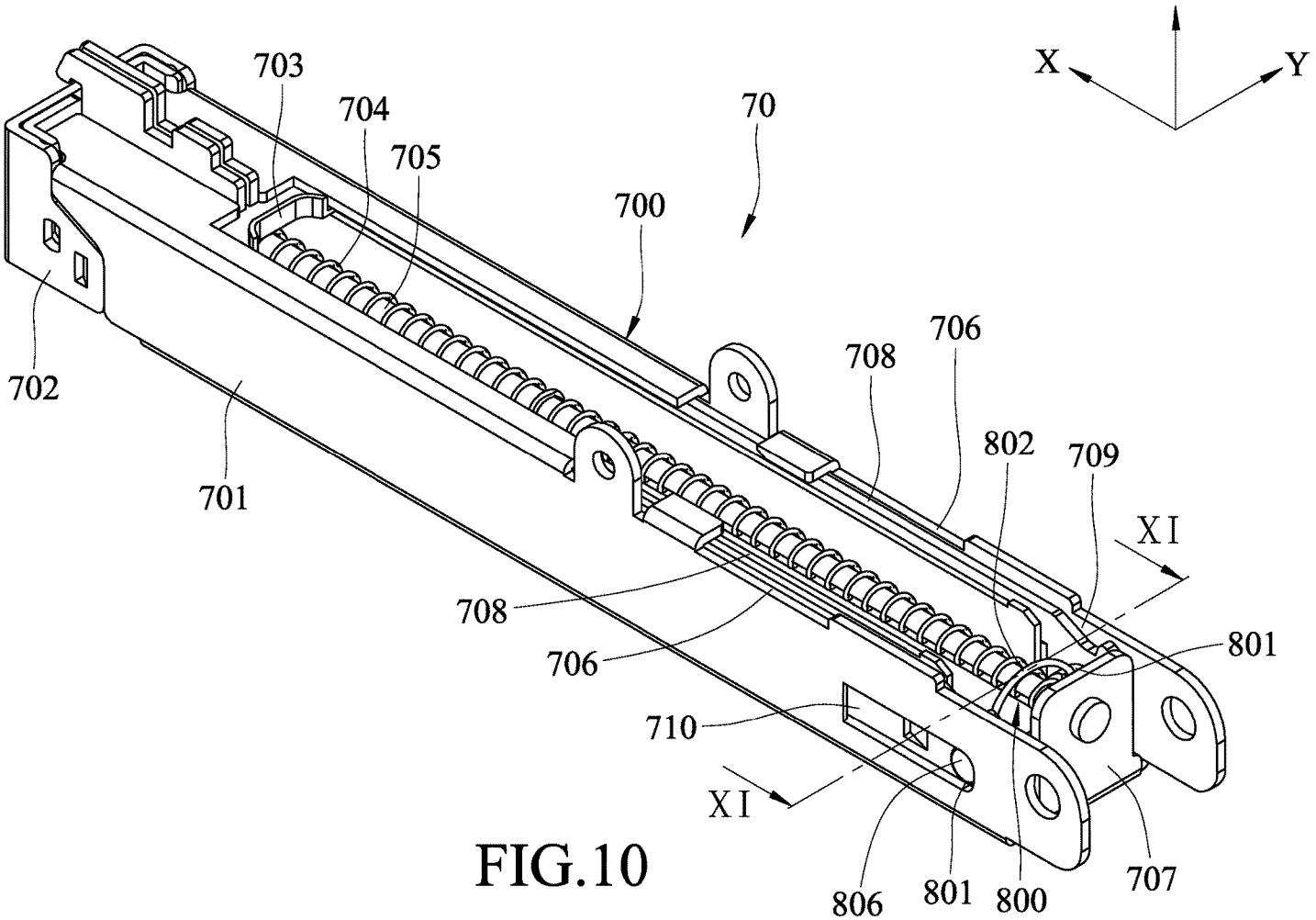
FIG. 10 is a perspective view of a magazine unit of another embodiment according to the disclosure.
Figure 11:
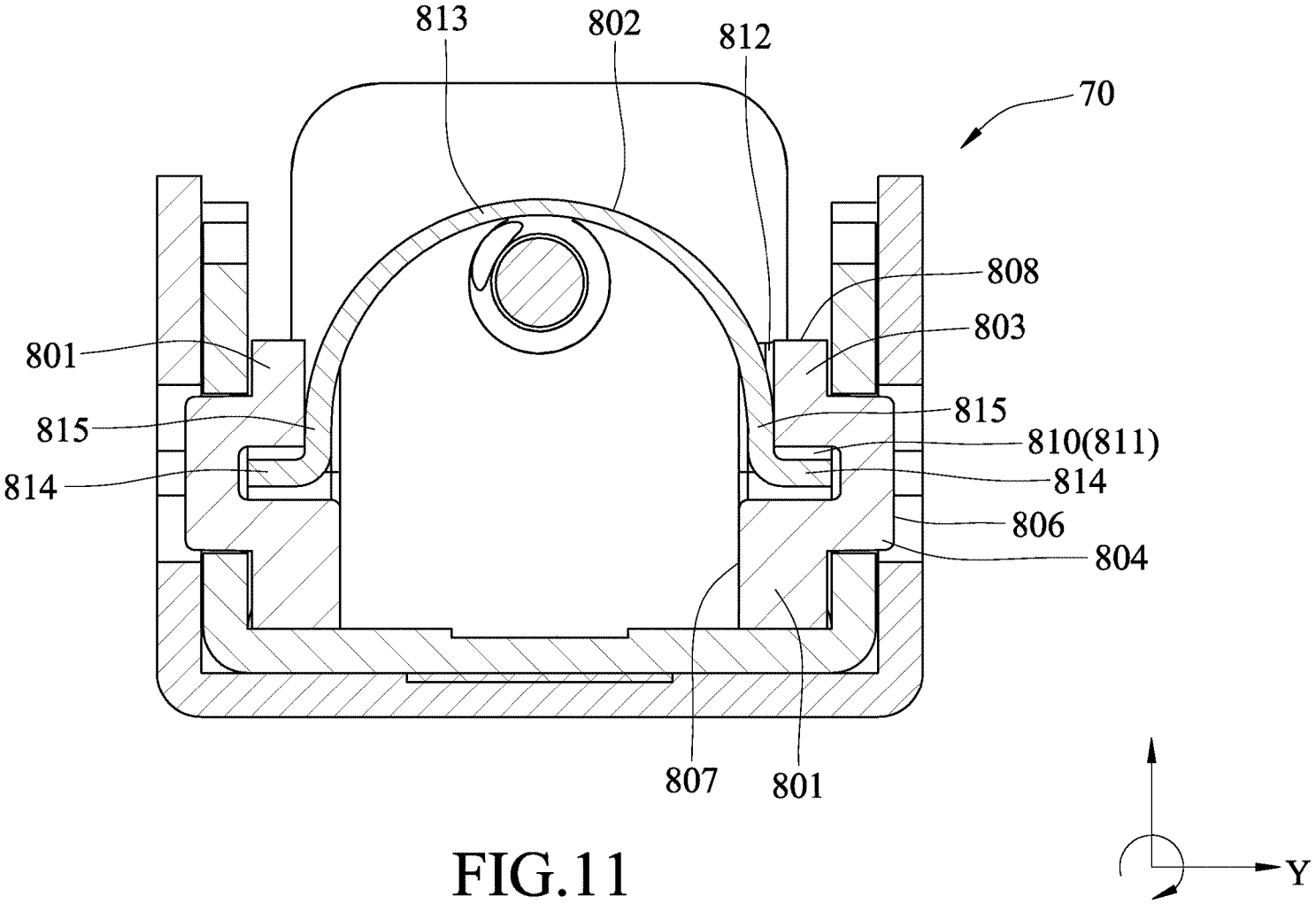
FIG. 11 is a sectional view taken along line XI-XI of FIG. 10.

Referring to FIGS. 10 and 11, in another embodiment, the shoulder portion 803 of each damping member 801 has an inner shoulder surface 807 opposite to the outer shaft portion 804, a peripheral shoulder surface 808 extending from a periphery of the inner shoulder surface 807 in the transverse direction (Y), and an engaging groove 810 formed in the inner shoulder surface 807. The engaging groove 810 has a horizontal segment 811 extending outwardly and in the transverse direction (Y) from the inner shoulder surface 807, and a vertical segment 812 extending upwardly from the horizontal segment 811 to the peripheral shoulder surface 808. The biasing member 802 has a curve segment 813 which has two end portions 815, and two engaging segments 814 which are respectively connected to the end portions 815 and which extend outwardly and in the transverse direction (Y). The engaging segments 814 are respectively engaged in the horizontal segments 811 to have the end portions 815 be respectively engaged in the vertical segments 812.

In this embodiment, the curve segment 813 of the biasing member 802 is configured not to interfere the central shaft 705 and hence the damping module 800 can be mounted on a more compact magazine module 700.

Figure 12:
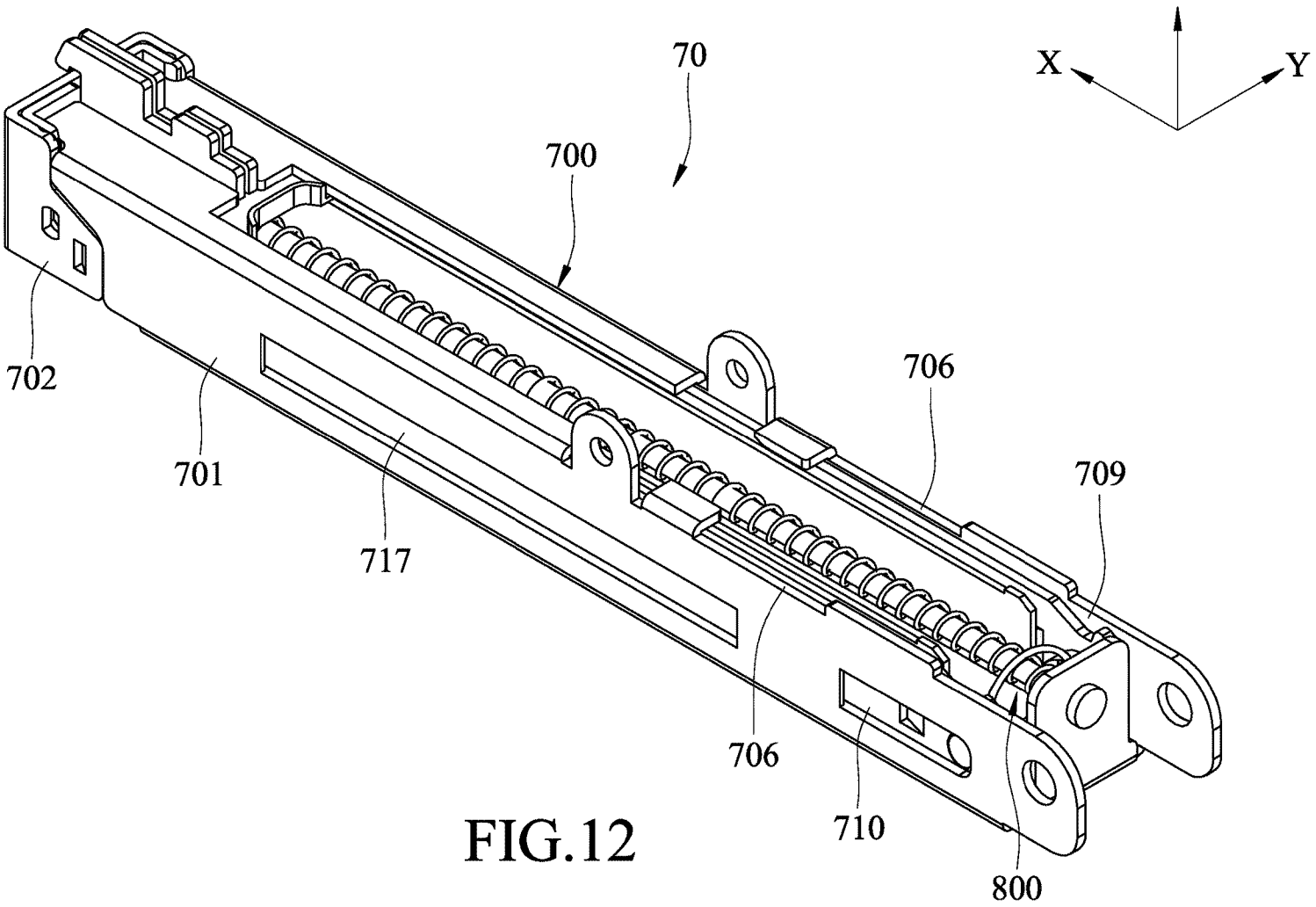
FIG. 12 is a perspective view of a magazine unit of still another embodiment according to the disclosure.
Figure 13:
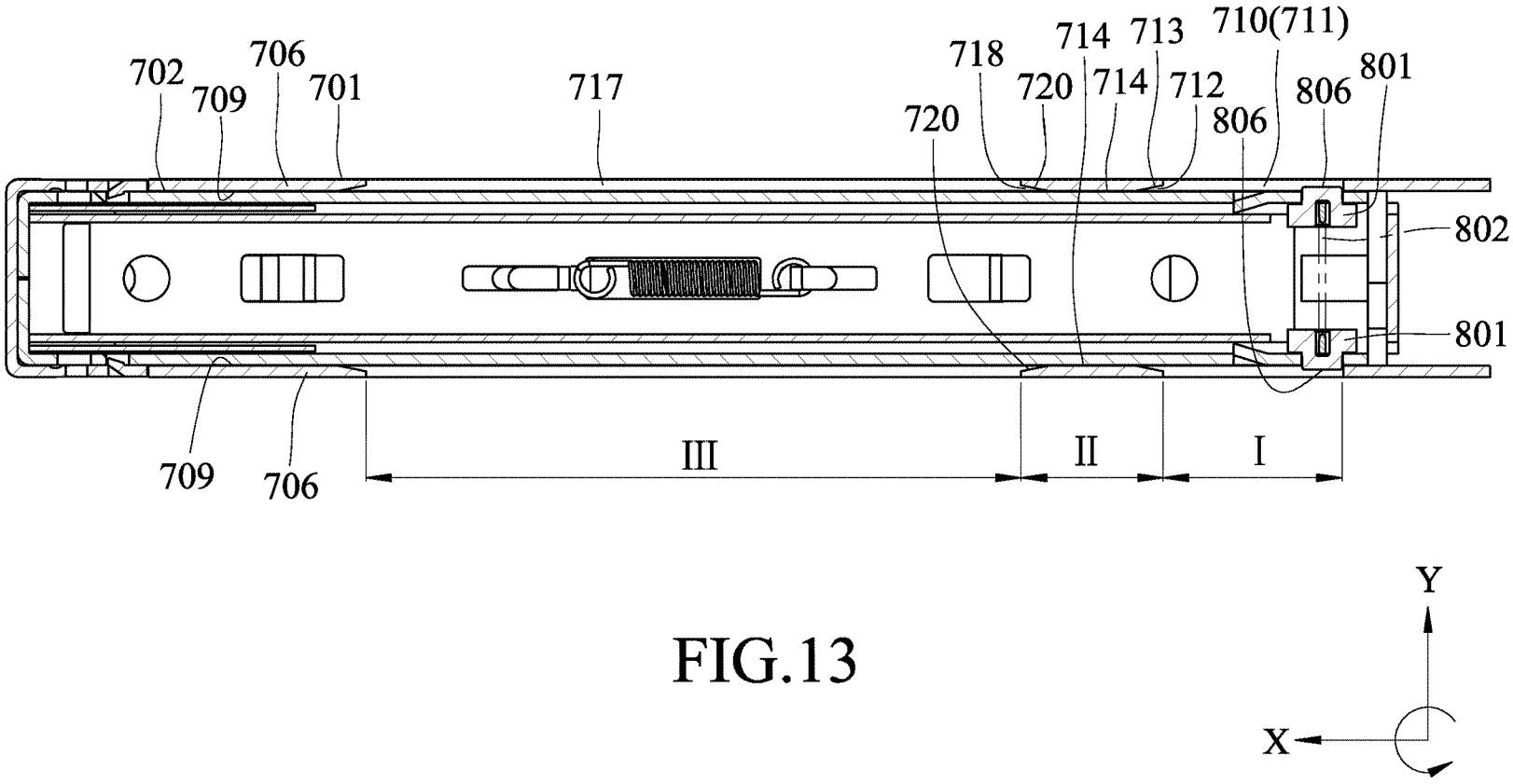
FIG. 13 is a sectional top view illustrating a state when a magazine track of the magazine unit of FIG. 12 is in a first position.

Referring to FIGS. 12 and 13, in another modified embodiment, each of the outer lateral wails 706 of the channel body 701 has a second recess 717 which is formed in the inner wall surface 709 and forwardly of the first recess 710 and which is elongated in the lengthwise direction (X) to terminate at a second rear recessed segment 718 proximate to the first recess 710. The second recess 717 is formed to penetrate through the outer lateral wall 706 in this embodiment. The inner wall surface 709 has a second rear inclined surface portion 720 which defines the second rear recessed segment 718. The second rear inclined surface portions 720 are gradually and forwardly diverged from each other in the transverse direction (Y)

Figure 14:
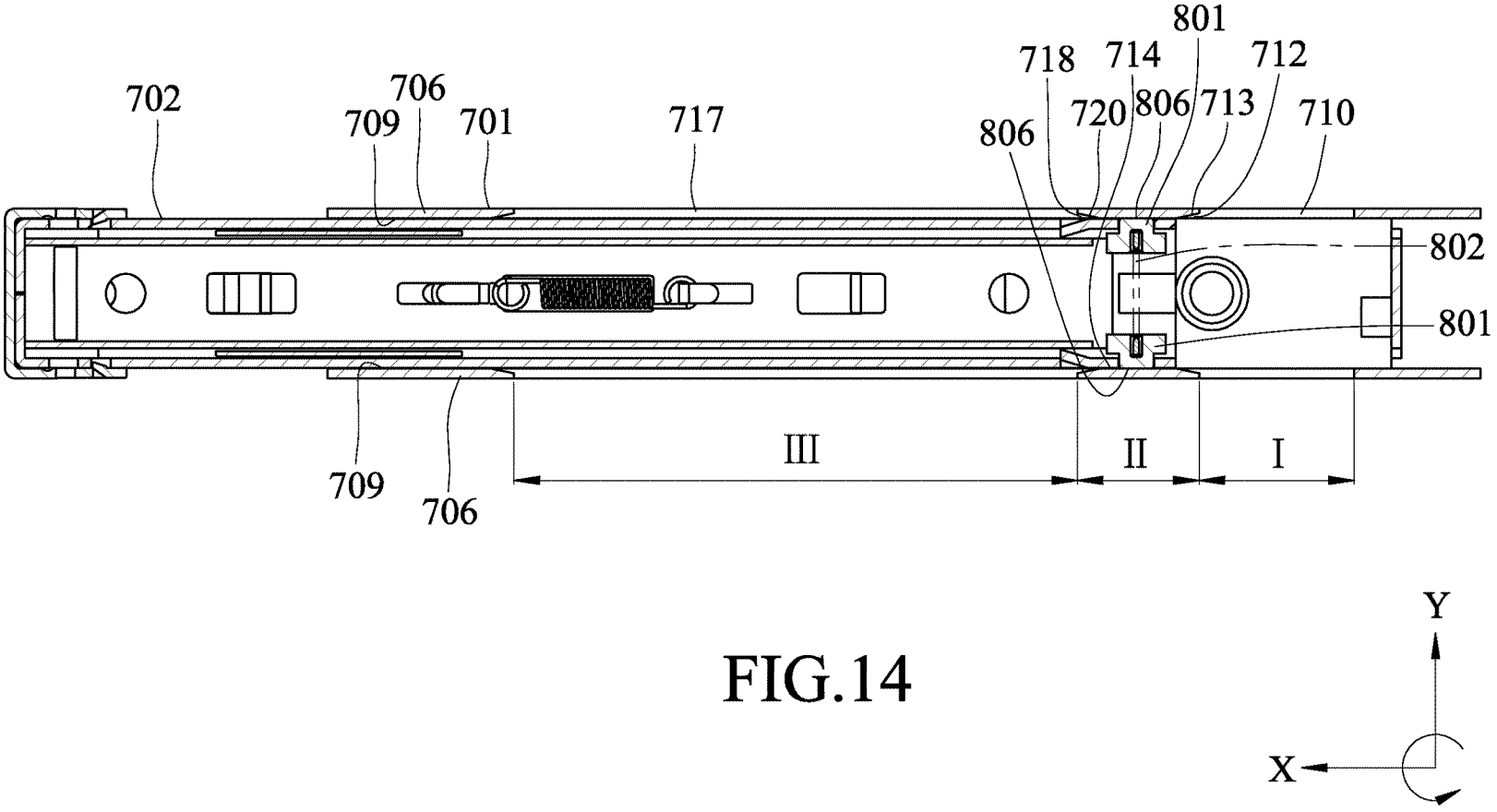
FIG. 14 is a sectional top view similar to FIG. 13, illustrating a state when the magazine track is in a second position.
Figure 15:
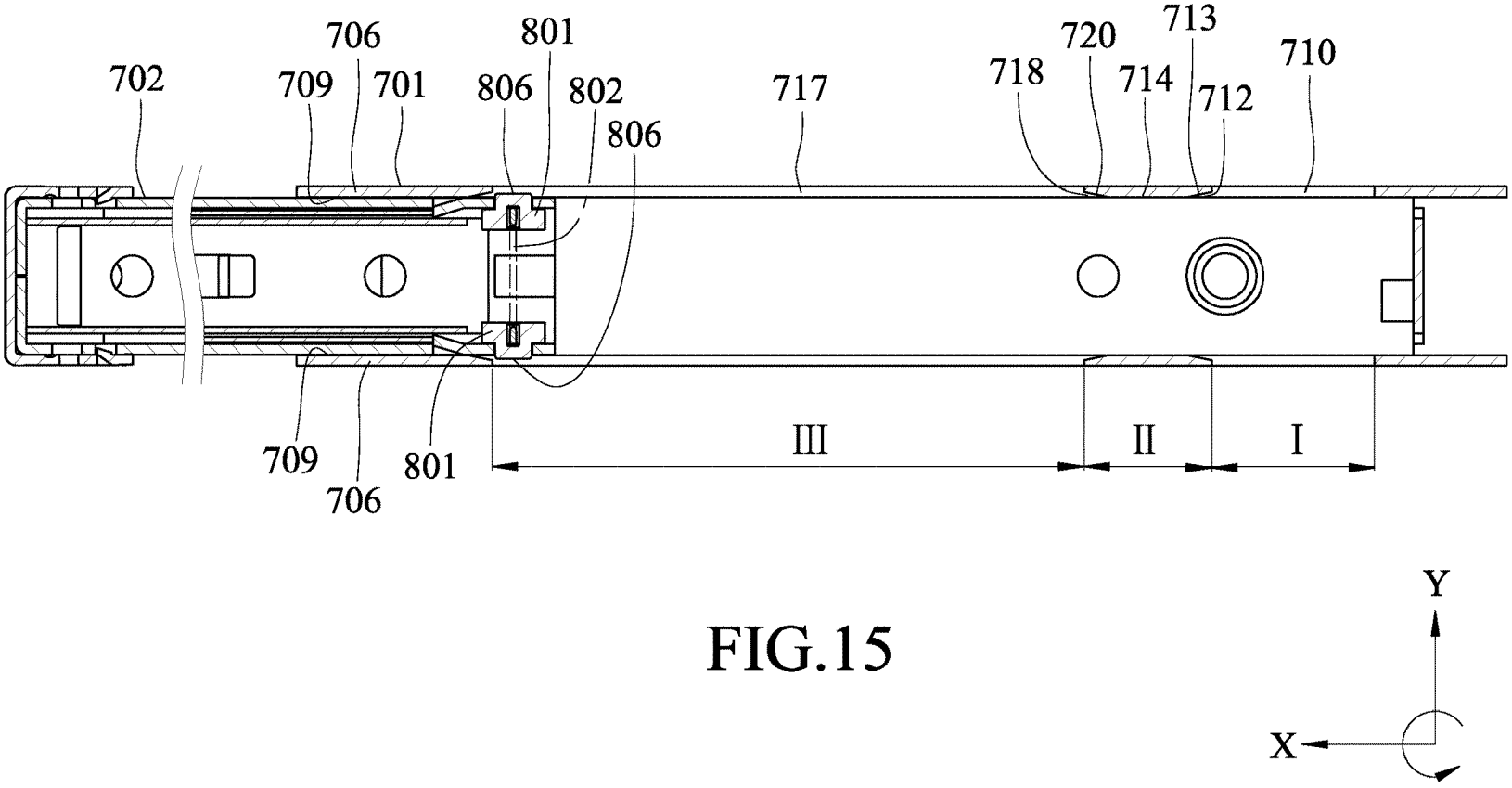
FIG. 15 is a sectional top view similar to FIG. 13, illustrating a state when the magazine track is in a third position.

Referring to FIGS. 14 and 15, when the magazine track 702 is in the second position (II) to be moved forwardly, the friction end 806 of each damping member 801 is in frictional engagement with the first inclined surface portion 713, the first friction portion 714 and the second rear inclined surface portion 720 and in this order. In this embodiment, the magazine track 702 is further moved forwardly to a third position (III), where the friction end 806 of each damping member 801 is disposed in the respective second recess 717 without contacting the inner wall surface 709 so as to facilitate the election movement of the magazine track 702 to the finish of the third position (III), as shown in FIG. 15. On the other hand, the magazine track 702 can be smoothly retracted back to the second position (II) by means of the second recess 717 and the second rear inclined surface portion 720.

Figure 16:
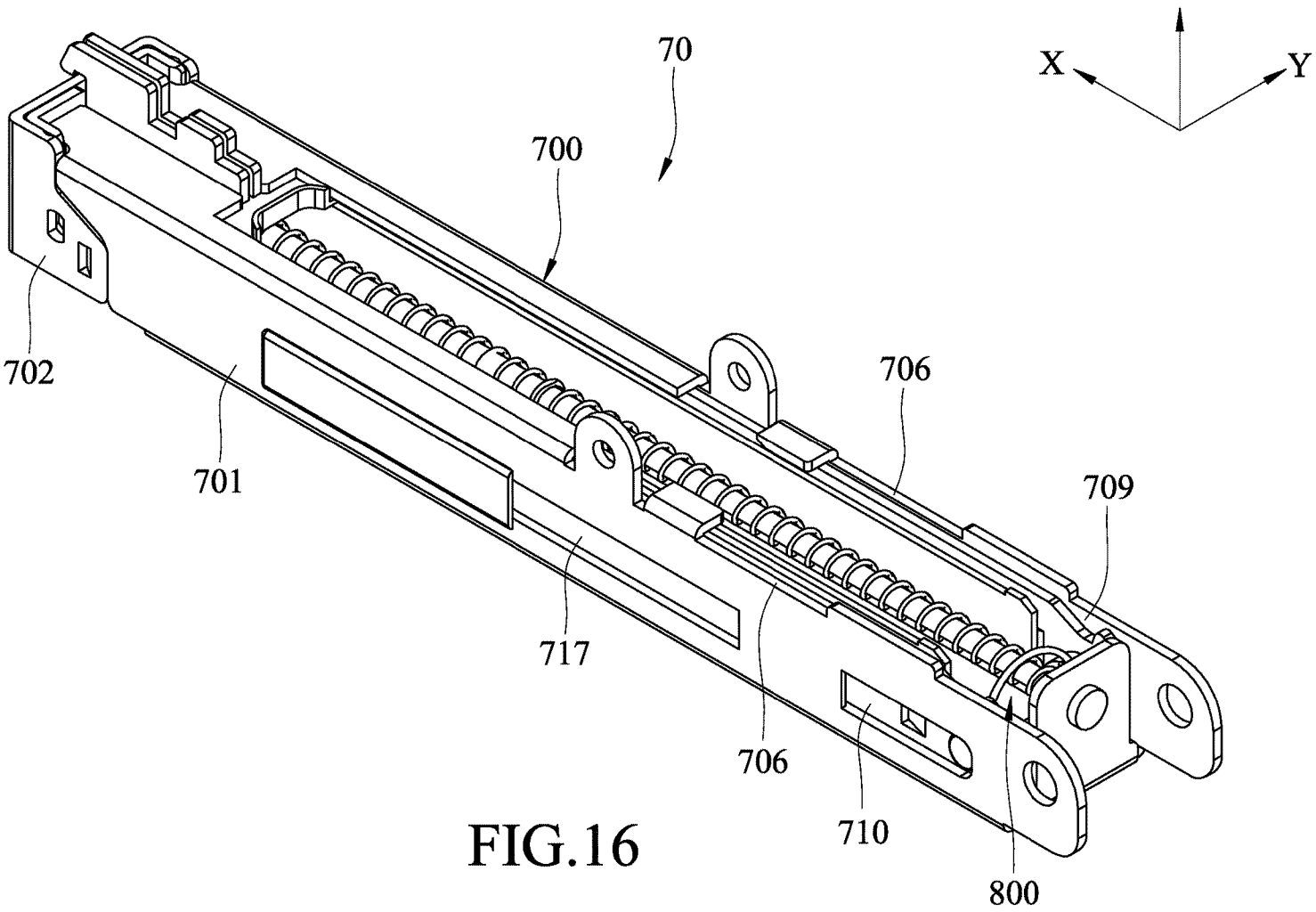
FIG. 16 is a perspective view of a magazine unit of another embodiment according to the disclosure.
Figure 17:
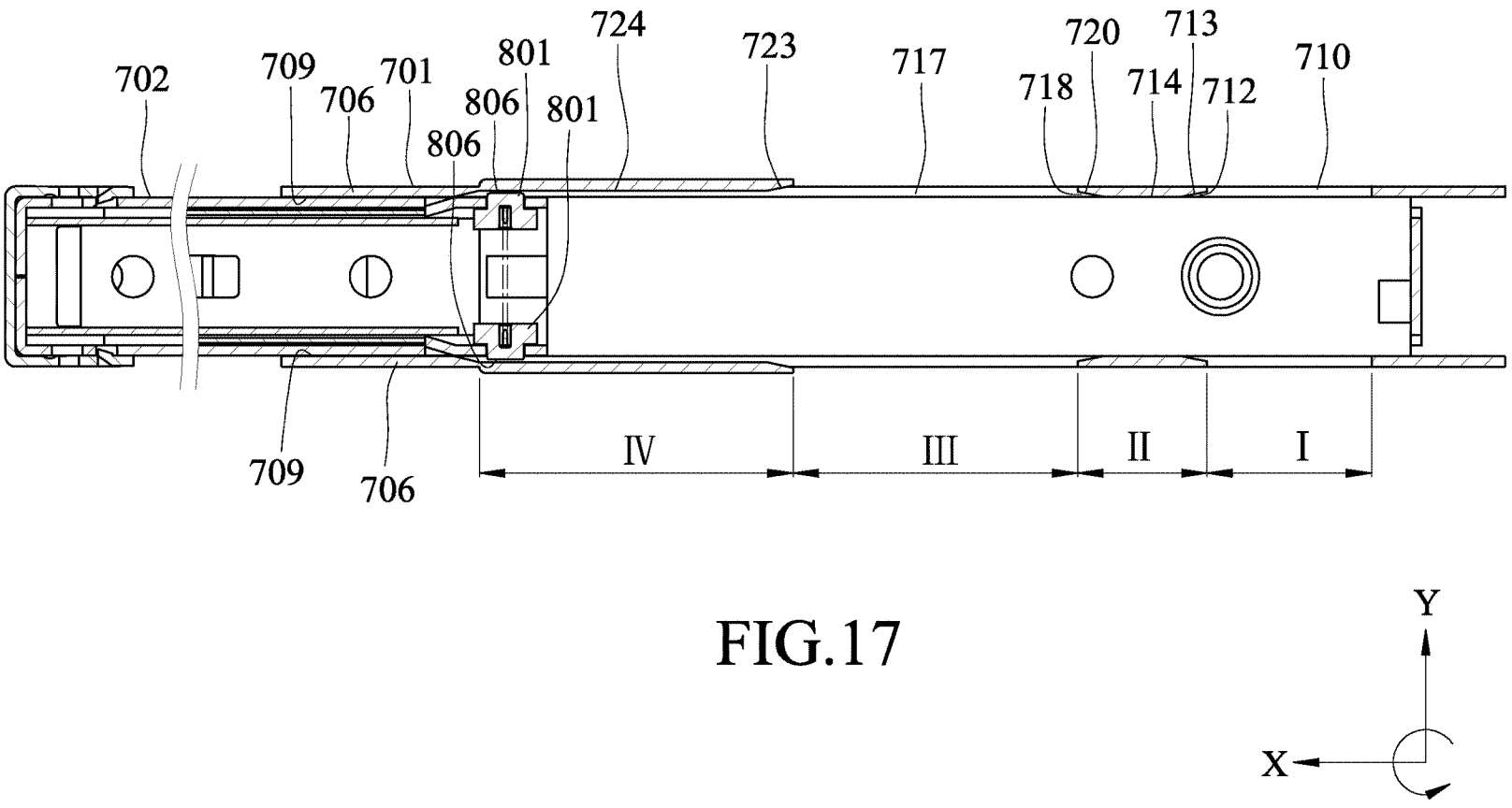
FIG. 17 is a sectional top view illustrating a state when a magazine track of a magazine unit of FIG. 16 is in a fourth position.

Referring to FIGS. 16 and 17, in still another embodiment, the inner wall surface 709 of each outer lateral walls 706 further has a second front inclined surface portion 723 which borders the second recess 717 and which is opposite to the second rear inclined surface portion 720 in the lengthwise direction (X), and a second friction portion 724 which extends forwardly from the second front inclined surface portion 723. The second front inclined surface portions 723 of the outer lateral walls 706 are gradually and forwardly converged toward each other. The second friction portions 724 of the outer lateral walls 706 define therebetween a distance which is larger than that defined between the first friction portions 714.

Thus, in this embodiment, the magazine track 702 is further moved forwardly to a fourth position (IV). During the movement of the magazine track 702 to the fourth position (IV), the friction end 806 of each damping member 801 is in frictional engagement with the second front inclined surface portion 723 and the second friction portion 724 and in this order.

As illustrated, with the frictional engagement between the damping members 801 and the inner wall surfaces 709 of the outer lateral walls 706 of the channel body 701, the ejection movement of the magazine track 702 from the channel body 701 is retarded for safety purposes.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A stapler comprising:

a base having a base rear end;

a handle pivotably connected to said base rear end of said base at a handle rear end; and a magazine unit interposed between said base and said handle, and including a magazine module having a channel body which is pivotably attached to said base rear end at a channel rear end thereof and which elongated in a lengthwise direction from said channel rear end to terminate at a channel front end, a magazine track which is coaxially disposed to and movable relative to said channel body in the lengthwise direction between a first position, where a magazine front end thereof is proximate to said channel front end, and a second position, where said magazine front end is distal from said channel front end, a pressing slider which is movably disposed between said channel body and said magazine track and adjacent to said channel front end of said channel body, and a magazine ejection spring which is disposed between said pressing slider and said channel body to bias said magazine track to the second position, said channel body being operably connected with said handle and having two outer lateral walls which are spaced apart from each other in a transverse direction that is transverse to the lengthwise direction and which are disposed outboard of said magazine track, each of said outer lateral walls having an inner wall surface and a first recess which is formed in said inner wall surface and which is elongated forwardly and in the lengthwise direction to terminate at a first front recessed segment, said inner wall surface having a first inclined surface portion which defines said first front recessed segment, and a first friction portion which extends forwardly from said first inclined surface portion, said first inclined surface portions of said outer lateral walls being gradually and forwardly converged toward each other, and a damping module disposed on said magazine track, and having two damping members which are movable relative to said magazine track in the transverse direction and which respectively have friction ends that are respectively disposed in said recesses when said magazine track is in the first position, and a biasing member which is disposed to bias said damping members in the transverse direction toward said inner wall surfaces of said outer lateral walls, respectively, such that, when said magazine track is moved from the first position to the second position, each of said friction ends is slidably moved on and frictionally engaged with at least one of said first inclined surface portion and said first friction portion.

2. The stapler as claimed in claim 1, wherein said magazine track has two inner lateral walls which are spaced apart from each other in the transverse direction and which are disposed inboard of said outer lateral walls, each of said inner lateral walls having a rear end portion adjacent to said channel rear end, and a through hole formed through said rear end portion, each of said damping members having a shoulder portion and an outer shaft portion which extends outwardly from said shoulder portion in the transverse direction and through said through hole to terminate at a respective one of said friction ends, said biasing member abutting against said shoulder portions of said damping members.

3. The stapler as claimed in claim 2, wherein each of said damping members has an inner shaft portion extending inwardly from said shoulder portion in the transverse direction, said biasing member being a compression coil spring which is sleeved around said inner shaft portions of said damping members and which is disposed to permit said friction ends of said damping members to be respectively spaced apart from said inner wall surfaces of said outer lateral walls.

4. The stapler as claimed n claim 2, wherein said shoulder portion of each of said damping members has an inner shoulder surface opposite to said outer shaft portion, a peripheral shoulder surface extending from a periphery of said inner shoulder surface in the transverse direction, and an engaging groove formed in said inner shoulder surface, said engaging groove having a horizontal segment extending outwardly and in the transverse direction from said inner shoulder surface, and a vertical segment extending upwardly from said horizontal segment to said peripheral shoulder surface, said biasing member having a curve segment which has two end portions, and two engaging segments which are respectively connected to said end portions and which extend outwardly and in the transverse direction, said engaging segments being respectively engaged in said horizontal segments to have said end portions be respectively engaged in said vertical segments.

5. The stapler as claimed in claim 1, wherein each of said outer lateral walls has a second recess which is formed in said inner wall surface and forwardly of said first recess and which is elongated in the lengthwise direction to terminate at a second rear recessed segment proximate to said first recess, said inner wall surface having a second rear inclined surface portion which defines said second rear recessed segment, said second rear inclined surface portions being gradually and forwardly diverged from each other in the transverse direction such that said friction end of each of said damping members is in frictional engagement with one of said first inclined surface portion, said first friction portion and said second rear inclined surface portion when said magazine track is placed in the second position, and such that said magazine track is further moved forwardly to a third position, where said friction end of each of said damping members is disposed in said second recess and is spaced apart from said inner wall surface.

6. The stapler as claimed in claim 5, wherein said inner wall surface of each of said outer lateral walls has a second front inclined surface portion which borders said second recess and which is opposite to said second rear inclined surface portion in the lengthwise direction, and a second friction portion which extends forwardly from said second front inclined surface portion, said second front inclined surface portions being gradually and forwardly converged toward each other, said second friction portions define therebetween a distance which is larger than that defined between said first friction portions such that said magazine track is further moved forwardly to a fourth position, where said friction end of each of said damping members is in frictional engagement with one of said second front inclined surface portion and said second friction portion.

7. The stapler as claimed in claim 1, wherein said channel body has a rear wall which is disposed between said outer lateral walls and at said channel rear end and which confronts said pressing slider, said magazine module having a central shaft which is disposed between said rear wall and said pressing slider and which is elongated in the lengthwise direction such that said pressing slider is slidable relative to said central shaft, said magazine election spring being a compression coil spring which is sleeved around said central shaft and which abuts against said pressing slider and said rear wall.

8. The stapler as claimed in claim 1, further comprising an operating unite, which is operably connected with said magazine track and which has a retaining member that is disposed to releasably retain said magazine track to the first position.

* * * * *